United States Patent [19]

Kochis

[11] 4,292,764

[45] Oct. 6, 1981

[54] MULTI-PANEL CLOSURES

[76] Inventor: August J. Kochis, 89 Brooktrail Rd., Concord, Mass. 01742

[21] Appl. No.: 788,422

[22] Filed: Apr. 18, 1977

[51] Int. Cl.[3] ..... E05F 1/04

[52] U.S. Cl. ..... 49/237; 49/9; 160/354

[58] Field of Search ..... 49/9, 34, 237; 160/354, 160/105; 52/403

[56] References Cited

U.S. PATENT DOCUMENTS

| | | | |
|---|---|---|---|
| 3,009,216 | 11/1961 | Kimber | 52/403 X |
| 3,146,826 | 9/1964 | Eckel | 49/9 X |
| 3,750,739 | 8/1973 | McGuire | 49/9 X |

FOREIGN PATENT DOCUMENTS

| | | | |
|---|---|---|---|
| 1117101 | 6/1968 | United Kingdom | 160/354 |

*Primary Examiner*—Kenneth Downey

*Attorney, Agent, or Firm*—Schiller & Pandiscio

[57] ABSTRACT

A multi-panel closure is disclosed in which a fastening member comprising a pair of integral back-to-back channels is positioned between the facing pair of edges of adjacent panels. The facing side sections of each channel grip the aforesaid edges between them. The panels are positioned so as to have at least one edge in alignment with each other. A split sleeve which is fastened to a rotatably supported closure post includes a pair of parallel flanges which receive the aligned panel edges therebetween and which are riveted to each panel along its aligned edge.

4 Claims, 5 Drawing Figures

MULTI-PANEL CLOSURES

The present invention relates in general to new and improved closures, in particular to doors which comprise a plurality of readily assembled panels.

Multi-panel closures are well known in the art. For certain types of applications, particularly where self-closing doors are employed which must accomodate heavy traffic, such as shopping carts or loaded dollies traveling in either direction, the panels must be light in weight and capable of withstanding abuse. Further, in order to provide such doors at low cost, the panels must be capable of being easily assembled by simple and economical fastening means.

Frequently the panels of a single door consist of different types of materials. For example, doors which swing in both directions, instead of having only a small window, may be advantageously provided with a transparent full-width panel that gives the person passing through the door an unobstructed view of people or objects entering from the other side. The remaining portion of the door may consist of a panel or panels of a more rugged, opaque material, suitable to their purpose. Sometimes, for certain applications of self-closing doors it may be desirable to have the upper door portion substantially rigid, while a flexible panel is used below where vehicles such as shopping carts, dollies, or the like are likely to be driven into contact with the door.

At times, the use of large panels of a given material may be prohibitively expensive. Often a considerable saving can be effected where smaller panels of the same material can be employed.

In all such applications a proper transition must be provided between adjacent panels. The transition must be capable of being quickly and economically installed and it must function to maintain the panels in a common plane.

In heretofore available multi-panel doors such transition structures for coupling adjacent panels together must often be custom-fitted and they therefore tend to raise the cost of the overall closure. Further, such transition structures often prove to be unsatisfactory where modifications must be made at the installation site, since substantial amounts of time may be required to modify and install these structures.

OBJECTS OF THE INVENTION

Accordingly, it is a primary object of the present invention to provide multi-panel closures that are not subject to the foregoing disadvantages.

It is another object of the present invention to provide a multi-panel door which employs transition structures that are quickly and easily installed and modified.

It is a further object of the present invention to provide multi-panel door which employ economical fastening members for joining together adjacent panels that can be economically manufactured and installed.

These and other objects of the present invention together with the features and advantages thereof will become apparent from the following detailed specification when read in conjunction with the accompanying drawings wherein like reference numerals refer to corresponding parts.

DESCRIPTION OF THE INVENTION

Figure 1:
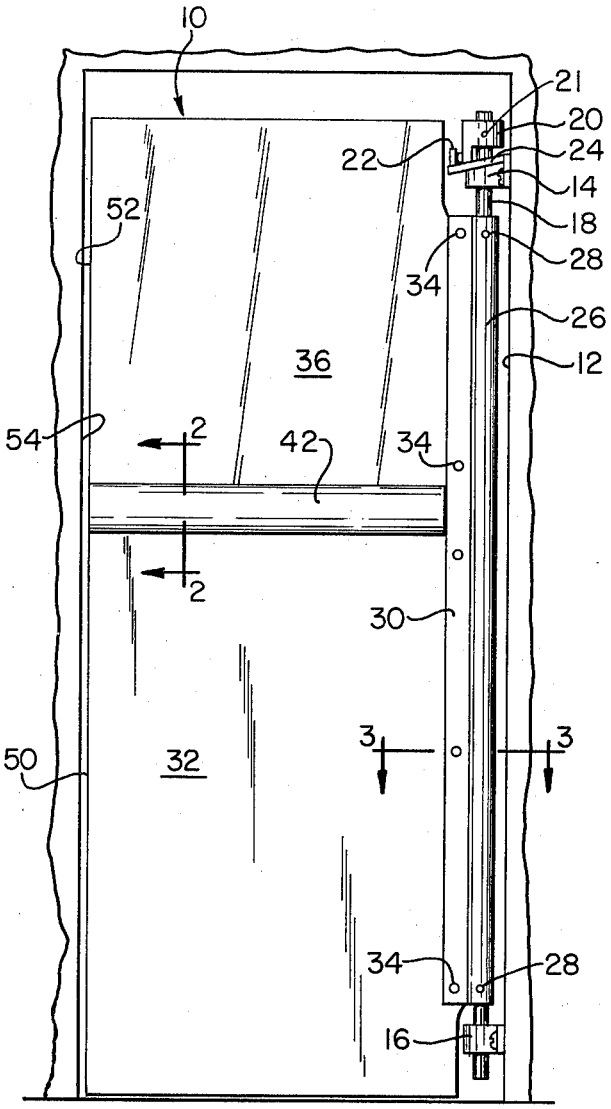
FIG. 1 illustrates one embodiment of the invention as applied to a self-closing door.

With reference now to the drawings, FIG. 1 illustrates a self-closing door 10 of the type wherein the present invention finds application. The door opening includes a vertical door jamb 12 to which a pair of bearings 14 and 16 is secured. A post 18 is rotatably supported in the bearings. A cam follower 20 is fastened to the upper end of post 18 by means of a pin 21 and it includes a roller 22. The latter rides on a cam track 24 which is integral with bearing 14. Roller 22 normally occupies a low point on cam track 24 which correspond to the closed position of the door. Bearing 14 is generally the same as the bearing 26 shown in U.S. Pat. No. 3384996.

Figure 3:
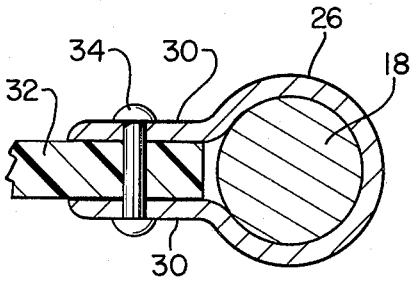
FIG. 3 illustrates another detail of the apparatus of FIG. 1 taken in cross-section at line 3—3.

A split sleeve 16 is fastened to post 18 by means of pins 28 so as to rotate therewith. As best shown in FIG. 3, sleeve 26 partially surrounds post 18 and includes a pair of substantially parallel flanges 30 of a length substantially coextensive with the sleeve.

Door 10 includes a pair of panels 32 and 36 disposed in a common plane, panel 32 being positioned below panel 36. The vertical edges of panels 32 and 36 are substantially aligned with each other and are received between parallel flanges 30. Rivets 34 serve to fasten flanges 30 to the panels at intervals spaced along the aforesaid aligned vertical edges.

Figure 2:
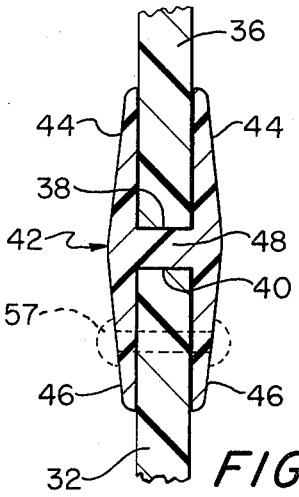
FIG. 2 illustrates a detail of the apparatus of FIG. 1 taken in cross-section at line 2—2.

As best seen from FIG. 2, panels 32 and 36 terminate in a pair of facing edges 38 and 40 respectively, which are spaced from each other. A stiff but resilient fastening member 42 comprises a bridge section 48 which separates a pair of back-to-back channels. Each of the channels includes a pair of converging side sections 44 and 46 respectively integral with bridge section 48. The construction of the fastening member permits its manufacture by an extrusion process, e.g. from a plastic material such as polypropylene or polyvinyl chloride. The spacing of channel side sections 44 and 46 is such that the respective channels can be force slipped over panel edges 38 and 40 to form a tight friction fit with panels 36 and 32 respectively. Thus, no adhesive or riveting is required to install fastening member 42 as a transition between adjacent panels.

Fastening member 42 extends horizontally from the end of flanges 30 to the free vertical edges 50 and 52 of panels 32 and 36 respectively. The latter edges are preferably aligned with each other.

In operation, the force applied by the person or object entering the door against either one of panels 32 or 36 or against fastening member 42, is transmitted as an applied torque to sleeve 26 and thence to post 18 which is caused to rotate in its bearings.

Fastening member 42 acts as a stiffener with respect to the door and also distributes the applied force such that the panels remain substantially coplanar as the door is rotated. Hence, panel flexing is minimized. When the applied force is released, cam follower 20 returns roller 22 to the low point on cam track 24, thereby rotating door post 18. The rotation of the door post is transmitted to split sleeve 26 and, by way of flanges 30, to door panels 32 and 36. Here again the fastening member acts as a stiffener to distribute the applied torque and to minimize panel flexing.

In a practical embodiment of the present invention, panel 36 may consist of a relatively stiff, transparent sheet, while panel 32 may consist of an opaque material, for example plastic or metal, which has the same or a greater degree of stiffness. Alternatively, panel 32 may consist of a material such as rubber or the like, which has a relatively high degree of flexibility. In the latter case, the gripping action of the side sections of fastening member 42 is preferably enhanced by the use of rivets spaced along the lower channel of the fastening member, as shown in broken lines at 57 in FIG. 2.

Figure 4:
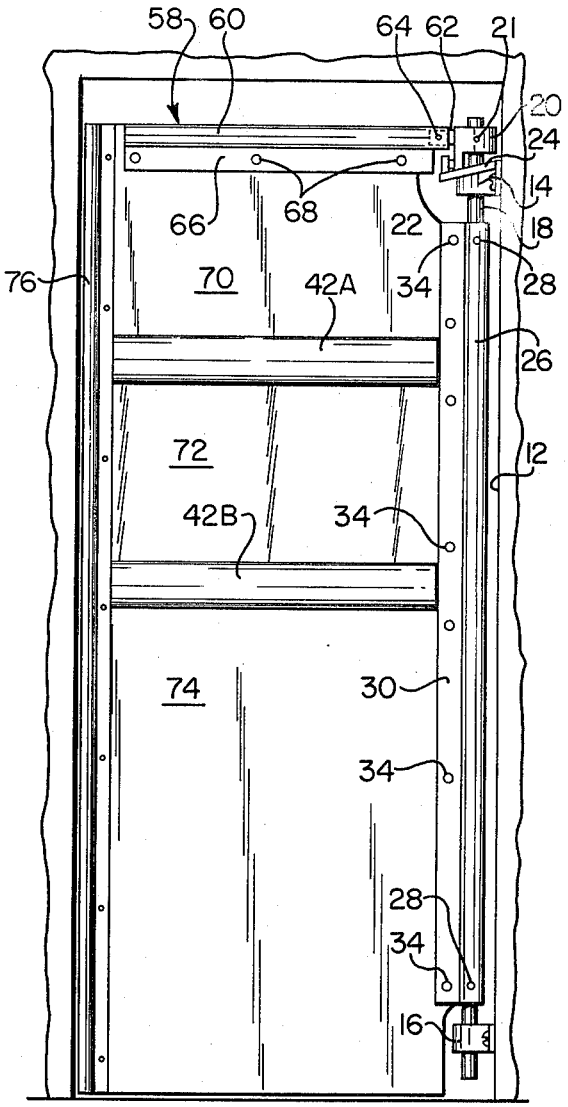
FIG. 4 illustrates the invention as applied to another type of self-closing door.
Figure 5:
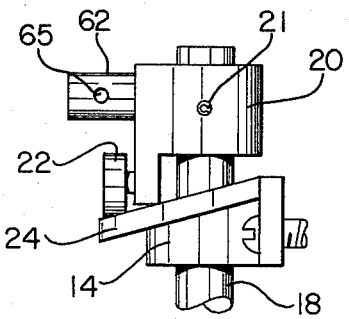
FIG. 5 is an enlarged view of a portion of the apparatus shown in FIG. 4.

FIG. 4 illustrates the present invention as applied to a different type of door 58. A split sleeve 60, which is similar in construction to split sleeve 26, is coaxially disposed on a boss 62. The latter, which is best seen from FIG. 5, is an integral radial extension of cam follower 20, which itself is secured to post 18 by means of pin 21. Cam follower 20 includes a roller 22 which rides on cam track 24, which itself is integral with bearing 14. Sleeve 60 is attached to boss 62 by means of at least one pin 64 which engages hole 65 in the boss. As in the case of the embodiment of FIG. 1, the door is supported by a pair of bearings 14 and 16 which are secured to door jamb 12 and in which post 18 is rotatably disposed.

As illustrated, door 58 comprises three panels 70, 72 and 74 respectively, which are disposed in a common plane. The aligned right hand edges of the three panels are positioned between flanges 30 of split sleeve 26 and they are fastened thereto by means of rivets 34 which are spaced along the last-recited edges.

The upper horizontal edge of panel 70 extends between flanges 66 of split sleeve 60, the latter flanges being fastened to panel 70 by means of rivets 68 spaced along the aforesaid upper horizontal edge. The presence of split sleeve 60 provides added support and rigidity to the overall door structure, thus permitting door 58 to respond more readily to torque applied thereto.

The left hand vertical edges of panels 70, 72 and 74 are aligned with each other and they are frictionally gripped by a nosing strip 76. Strip 76, which extends from below flanges 66 to the bottom of panel 74, comprises a channel-form arrangement which may be similar in construction to a single channel of fastening member 42. Strip 76 may be relatively rigid but preferably it is pliant and is made of rubber or a resilient plastic so as to function as a compressible shock-absorbing edge for the door. Strip 76 may be adhesively secured to the panels or it may be fastened thereto by a friction grip, as already mentioned.

Panels 70, 72 and 74 are positioned in a common plane such that the facing edges of adjacent panels are spaced from each other. A pair of fastening members 42A and 42B provide transitions between successive pairs of facing panel edges and they are substantially identical in construction to the fastening member illustrated in FIG. 2. Both fastening members 42A and 42B extend between flanges 30 of split sleeve 26 and nosing member 76. Thus, the lower horizontal edge of panel 70 will be gripped by the upper channel portion of fastening member 42A, while the upper horizontal edge of panel 72 is gripped by the lower channel portion of the same fastening member. Similarly, the lower horizontal edge of panel 72 is gripped by the upper channel portion of fastening member 42B and the upper horizontal edge of panel 72 is gripped by the lower channel portion of the same fastening member.

One of the salient advantages of the present invention resides in the ability of the fastening members to be readily slid into place. Such an operation is carried out with the panels held only by the flanges of the respective split sleeves 26 and 60 and with nosing member 76 removed. Thus, a relatively large closure can be quickly, easily and economically assembled by the use of fastening members in accordance with the present invention. As observed above, each fastening member serves to hold the panels in a common plane, to stiffen door 48, and to distribute any force applied thereto. Further, the fastening members themselves may be economically manufactured by an extrusion process or the like.

A number of variations of the invention described above are possible. It has already been mentioned that a panel having different degrees of rigidity may be employed. Similarly different types of panels may be used for the same door. For example, panel 72 in FIG. 4 may be transparent, while the other panels are opaque. Further, the panels may be positioned horizontally adjacent each other in a common plane, i.e. with facing pairs of panel edges extending in a vertical direction, gripped by vertically extending fastening members.

From the foregoing explanation, it will be apparent that numerous variations, modifications and substitutions will now occur to those skilled in the art, all of which fall within the spirit and scope contemplated by the present invention. Accordingly, the invention is intended to be limited only by the scope of the appended claims.

What is claimed is:

1. A closure comprising:

a post rotatably supported in a pair of bearings mutually spaced in a vertical direction and each adapted to be mounted on a fixed surface;

a cam track integral with the upper one of said bearings;

a cam follower fastening to said post and adapted to rotate therewith, said cam follower being adapted to ride on said cam track and to return to a preferred position thereon;

a horizontal boss integral with said cam follower;

a plurality of coplanar panels mutually aligned along at least one edge of each panel, said last-recited edges jointly being substantially coextensive in length to said post and parallel thereto, adjacent ones of said panels being spaced from each other along a pair of mutually facing, substantially horizontal edges;

a first split sleeve coaxially mounted on said post so as to rotate therewith, said first sleeve including a pair of substantially parallel flanges substantially coextensive in length with said first sleeve, said flanges being secured to opposite sides of said plurality of panels along said one edge of each panel;

a second split sleeve coaxially mounted on said boss at right angles to said post so as to rotate with said post, said second sleeve including a pair of substantially parallel flanges substantially coextensive in length with said second sleeve, said last-recited flanges being secured to opposite sides of the uppermost one of said plurality of panels along the upper horizontal edge thereof; and a substantially rigid fastening member positioned between at least one pair of said facing panel edges, said fastening member comprising a pair of channels disposed in back-to-back relationship on opposite sides of a bridge section, each of said channels including a pair of converging side sections integral with said bridge section and frictionally gripping one of said pair of mutually facing panel edges.

2. Apparatus according to claim 1 wherein said panels are vertically disposed adjacent each other in a common plane.

3. Apparatus according to claim 1 wherein the lowest one of said plurality of coplanar panels consists of a flexible material, the channel side sections of said fastening member which grip the upper horizontal edge of said last-recited panel being additionally secured thereto by means of rivets spaced along said last-recited edge.

4. Apparatus according to claim 2 wherein each of said panels further includes a free vertical edge, said free vertical edges of respective panels being aligned with each other, and a nosing strip disposed along said last-recited panel edges, said nosing strip comprising a channel including a pair of converging side sections which frictionally grip said last-recited panel edges, said fastening member extending between said last-recited side sections and the flanges of said first split sleeve.

* * * * *

UNITED STATES PATENT AND TRADEMARK OFFICE

CERTIFICATE OF CORRECTION

PATENT NO. : 4292764

DATED : October 6, 1981

INVENTOR(S) : August J. Kochis

It is certified that error appears in the above-identified patent and that said Letters Patent are hereby corrected as shown below:

Claim 1, column 4, line 41, the word "fastening" should be -- fastened --.

Signed and Sealed this

*Twenty-ninth* Day of *December 1981*

[SEAL]

*Attest:*

GERALD J. MOSSINGHOFF

*Attesting Officer*

*Commissioner of Patents and Trademarks*